United States Patent [19]

Wagenaar

[11] 4,132,853

[45] Jan. 2, 1979

[54] ELECTRICAL BUSHING

[75] Inventor: Loren B. Wagenaar, Muncie, Ind.

[73] Assignee: Westinghouse Electric Corp., Pittsburgh, Pa.

[21] Appl. No.: 790,225

[22] Filed: Apr. 25, 1977

[51] Int. Cl.[2] ..... H01B 17/26

[52] U.S. Cl. ..... 174/12 BH; 174/15 BH

[58] Field of Search ..... 174/11 BH, 12 BH, 14 BH, 174/15 BH, 16 BH, 18, 31 R, 143

[56] References Cited

U.S. PATENT DOCUMENTS

| | | | |
|---|---|---|---|
| 1,878,094 | 9/1932 | Atkinson | 174/15 BH |
| 2,853,538 | 9/1958 | Frakes | 174/12 BH |
| 3,178,504 | 4/1965 | Frakes et al. | 174/12 BH |
| 3,626,079 | 12/1971 | Keen, Jr. et al. | 174/15 BH |

FOREIGN PATENT DOCUMENTS

| | | | |
|---|---|---|---|
| 541444 | 10/1955 | Belgium | 174/15 BH |
| 1380998 | 10/1964 | France | 174/15 BH |
| 45-25313 | 10/1970 | Japan | 174/15 BH |

*Primary Examiner*—Laramie E. Askin
*Attorney, Agent, or Firm*—D. R. Lackey

[57] ABSTRACT

An electrical insulating bushing with longitudinally extending channels for parallel coolant flow across the entire inner and outer surfaces of a hollow conductor. A first channel is formed by a plurality of ducts disposed between the conductor and a layer of insulative material which surrounds the electrical conductor; while a second channel is formed by a tubular member concentrically disposed within and radially spaced from the electrical conductor. An insulative bushing housing is spaced from the outer surface of the layer of insulative material to form a longitudinally extending third channel, the ends of which are in fluid flow communication with the ends of the first channel. Circumferentially spaced apertures in the upper and lower ends of the electrical conductor dispose the second channel in fluid flow communication with the third channel such that the coolant rises in the first and second channels to the top of the bushing by thermosiphon action and is returned through the third channel to the bottom of the insulating bushing. In another embodiment, an expansion cap provides an oil-tight seal between the housing of the insulating bushing and the conductor despite differences in thermal expansion of the members. Coolant flows from the second channel through circumferentially spaced apertures in the electrical conductor into the expansion cap wherein radially extending ducts in the lower spring seat of the compression spring assembly contained within the expansion cap define a fluid flow path between said cap and said third channel which directs the flow of coolant against the walls of the expansion cap for efficient heat transfer.

7 Claims, 4 Drawing Figures

ELECTRICAL BUSHING

BACKGROUND OF THE INVENTION

1. Field of the Invention

This invention relates, in general, to electrical insulating bushings and, more specifically, to electrical insulating bushings of the fluid-filled type.

2. Description of the Prior Art

Electrical insulating bushings are utilized to connect electrical apparatus, such as transformers, circuit breakers and the like, to an electrical circuit. The current rating of conventional bushings, especially those used in high current applications, is directly proportional to the quantity of heat that is dissipated from the current carrying conductor. In order to prevent excessive temperature rise in the conductor during current flow and also to minimize the size of the bushing itself, cooling means are used to dissipate the heat generated by the current carrying members of the bushing.

A typical approach is shown in U.S. Pat. No. 2,859,271, issued to D. Johnston et al, and U.S. Pat. No. 1,878,094, to R. Atkinson, wherein an insulative tubular sleeve is radially spaced from the conductor such that an annular duct is formed therebetween. The duct is disposed in fluid communication with an outer channel formed between the insulative sleeve and the outer housing of the bushing. Dielectric fluid, such as oil, flows through the duct by a thermosiphon action and thereby dissipates heat from the central conductor. The quantity of heat dissipated by such a bushing is limited since only the surface of the central conductor exposed to the duct is cooled by the oil.

U.S. Pat. No. 3,626,079, issued to Keen and Lynch, discloses a similar bushing construction in which the current carrying conductor is formed of a pair of concentric tubular electrodes connected together with an annular duct therebetween, which in turn is radially spaced around a hollow insulative shell. Oil is pumped from an oil-filled electrical apparatus through the hollow shell and, by a series of baffles and apertures, flows along the outer surface of the outer electrode, through the annular duct between the two electrodes and across the inner surface of the inner electrode to the oil-filled tank. Although such a construction exposes the entire surface of both conductors to the dielectric fluid, a pump is required to force the oil through the ducts. A similar approach is shown in U.S. Pat No. 1,706,810, issued to W. Paul, wherein a coolant fluid, in this case air, flows down through a hollow central conductor and up through an annular duct formed between the outer surface of the conductor and the insulative housing of the bushing. In these types of bushings, the coolant fluid flows serially across the surface of the conductors, that is, the same fluid flows across both the inner and outer surfaces of the conductor. The heat dissipation capability of a given quantity of dielectric fluid progressively decreases in such a bushing since the temperature of the fluid increases as it flows across the conductor surface which reduces the amount of heat that can be dissipated by a given quantity of dielectric fluid and thus lowers the current carrying capability of the bushing.

Furthermore, it is necessary to provide means to prevent the leakage of coolant from fluid-filled bushings caused by the differences in thermal expansion of the central conductor and the exterior bushing housing. A typical approach, as disclosed in U.S. Pat. Nos. 2,853,538, 2,933,551 and 3,178,504, all assigned to the assignee of the present invention, utilizes an expansion cap surrounding the central conductor of the bushing and having a plurality of compression springs disposed therein which exert tensile stress on the conductor and compressive stress on the exterior bushing housing to ensure an oil-tight seal over the entire operating range of the bushing. Although the expansion cap provides adequate sealing for the bushing, it does not provide additional cooling for the oil contained within the housing and, in particular, for the portion of the conductor contained within the expansion cap which can become excessively hot during current flow. Thus, it would be desirable to provide an electrical insulating bushing for use in high current applications which has a higher current carrying capability than that attainable in prior art insulating bushings due to improved cooling techniques. It would also be desirable to provide a new and improved insulating bushing wherein efficient cooling of the current carrying members is achieved by thermosiphon flow thereby eliminating the need for forced coolant flow by means of mechanical pumps.

SUMMARY OF THE INVENTION

Herein disclosed is a new and improved electrical insulating bushing which has a higher current carrying capability than similar sized bushings constructed according to prior art techniques. The bushing includes a longitudinally extending, hollow electrical conductor; a portion of which is surrounded by a layer of insulative material. Longitudinally extending channels are formed between the layer of insulative material and the outer surface of the electrical conductor which extend completely through the entire length of the insulative material. A longitudinally extending tubular member is disposed concentrically within and radially spaced from the inner surface of the electrical conductor to form a second channel which extends the entire length of the electrical conductor. A hollow insulating housing surrounds the layer of insulative material and is spaced therefrom to form a third channel, the ends of which are disposed in fluid flow communication with the ends of the first channel adjacent the outer surface of the conductor. Circumferentially spaced apertures in the upper and lower portions of the electrical conductor dispose the second or inner channel in fluid flow communication with the third channel. Dielectric fluid completely fills all of the channels and, as the temperature of the conductor rises under load, the fluid will rise through the first and second channels by thermosiphon action thereby removing heat from the entire inner and outer surfaces of the electrical conductor and then be returned through the third channel to the bottom of the bushing dissipating the heat contained therein through the insulative housing of the bushing to the ambient air.

An unexpected increase in the current-carrying capability of the bushing was found to result from the simultaneous parallel flow of the coolant fluid by thermosiphon action through the first and second channels across the entire inner and outer surfaces of the electrical conductor. The unique use of parallel channels for coolant flow across the inner and outer surfaces of the conductor removed heat from the conductor in sufficient quantities that a smaller insulating bushing was able to carry a higher current than would normally be expected.

In another embodiment of this invention, an expansion cap is utilized to maintain an oil-tight seal despite the dimensional changes caused by differences in the thermal expansion of the metallic conductor and the insulative housing of the bushing. In this embodiment, the coolant fluid from the second or inner channel is discharged directly into the expansion cap instead of into the upper portion of the insulative housing of the bushing. This not only exposes the portion of the electrical conductor contained within the expansion cap to the coolant fluid but also provides additional surface area for the dissipation of the heat contained within the coolant fluid since the coolant is forced to flow along the metallic casing of the expansion cap. Radially extending ducts in the lower spring seat of the compression spring assembly contained within the expansion cap force the dielectric fluid to flow in proximity to the walls of the casing of the expansion cap to ensure the dissipation of a portion of the heat contained within the coolant. The coolant fluid contained within the expansion cap flows through apertures at the ends of the ducts in the lower spring seat to the third channel-contained within the insulative housing of the bushing.

In addition, individual, annular insulative members are disposed between each spring seat and the electrical conductor to prevent the generation of current in the compression springs and also to expose the portion of the electrical conductor contained between the spring seat to the coolant fluid.

By discharging the coolant fluid into the expansion cap and insulating only the portion of the conductor contained within the expansion cap that is adjacent each spring seat, cooling of the portion of the conductor contained within the expansion cap is achieved, thereby preventing excessive temperature rises from occurring in this portion of the conductor. In addition, by combining the parallel channel arrangement described above with the improved cooling construction of the expansion cap assembly, the overall current-carrying capability of the electrical insulating bushing is increased since additional quantities of heat are dissipated from the coolant fluid through the substantial surface area of the casing of the expansion cap.

BRIEF DESCRIPTION OF THE DRAWINGS

The various features, advantages and other uses of this invention will become more apparent by referring to the following detailed description and drawing in which.

DESCRIPTION OF THE PREFERRED EMBODIMENT

Figure 1:
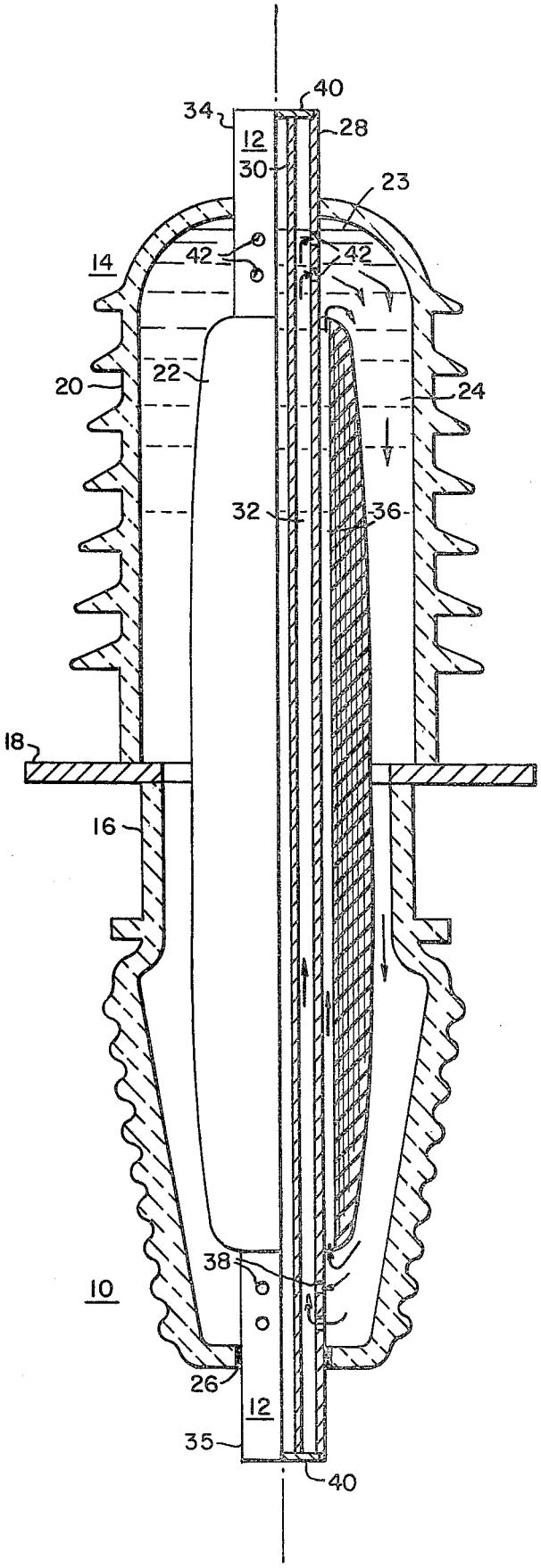
FIG. 1 is an elevational view, partially in section and partially broken away, of an electrical insulating bushing constructed according to the teachings of this invention.

Throughout the following description, identical reference numbers are used to refer to the same component in all figures of the drawing.

Referring to the drawing, and to FIG. 1 in particular, there is shown an electrical insulating bushing 10 employed in the tank of an electrical apparatus, such as a transformer, circuit breaker or the like, for connecting leads from the electrical apparatus contained within the tank to an exterior electrical circuit. The bushing 10 has a hollow central conductor 12 extending throughout the length of the bushing 10 which is adapted for connection by terminals, not shown, to the electrical apparatus on one end and the exterior electrical circuit on the other. Surrounding the central conductor 12 is an exterior housing 14 constructed of an electrical insulating material, such as porcelain. The housing 14 is divided into a lower porcelain support 16 which extends into the electrical apparatus, a metallic flange 18 joined to the lower support 16 by suitable means, such as welding, and an upper porcelain support 20 which is joined to the central conductor 12 at its upper end by suitable means, such as brazing or soldering, to form an oil-tight seal. As shown in FIG. 1, an oil-tight seal is formed between the housing 14 and the lower end of the central conductor 12 by suitable sealing means, such as gasket 26 or by welding or soldering the housing 14 to the conductor 12. The central conductor 12 is constructed of a hollow electrical conductor 28 of suitable electrically conductive material such as copper or aluminum. The electrical conductor 28 is used to carry current through the bushing 10 and as such its diameter will vary depending upon the current capacity desired for a particular application. A cylindrical or tubular member 30 is concentrically disposed within electrical conductor 28 and is radially spaced therefrom such that a longitudinally extending annular channel or duct 32 is formed which extends the entire length of the electrical conductor 28. The first end 34 and the second end 35 of the electrical conductor 28 are sealed by plugs 40 which are joined by suitable means, such as welding, to the conductor 28 to seal the ends of the channel 32. As shown in FIG. 1, a layer of insulative material 22 surrounds the central conductor 12 within the bushing housing 14 and provides electrical insulation therefor. According to the preferred embodiment of this invention, the insulative material 22 consists of an oil-impregnated Kraft paper with metallic foil disposed therein to form a conventional condenser bushing which distributes the electrical stresses across the entire length of the central conductor 12. It is understood that the metallic foil need not be utilized in certain applications, typically those involving lower voltages, in which case the layer of an insulative material 22 would consist solely of paper or other suitable insulative material.

The inner surface of the housing 14 is radially spaced from the layer of insulative material 22 to form a channel or duct 24, the use of which will be described later.

In addition, spacer members, not shown, are placed between the insulative material 22 and the electrical conductor 28 to form a plurality of longitudinally extending annular channels or ducts which extend between the electrical conductor 28 and the entire length of the insulative material 22. For convenience throughout the following description, the channel 36 extending between the electrical conductor 28 and the layer of insulative material 22 will be referred to as the first channel, channel 32 between the electrical conductor 28 and the inner member 30 will be referred to as the second channel and channel 24 between the insulative material 22 and the exterior housing 14 of the bushing 10 will be referred to as the third channel.

As shown in FIG. 1, the upper and lower ends of the first channel 36 and the third channel 24 are disposed in fluid flow communication. Furthermore, the electrical conductor 28 contains a plurality of circumferentially spaced first apertures or openings 38 adjacent the second end 35 of the conductor which dispose the lower end of the second channel 32 in fluid flow communication with the lower end of the third channel 24. In addition, the electrical conductor 28 contains a plurality of circumferentially spaced second apertures or openings 42 adjacent the top or first end 34 of the electrical conductor 28 which also dispose the second channel 32 in fluid flow communication with the third channel 24.

In operation, all of the channels will be filled with a suitable coolant fluid 23, such as mineral oil, which is utilized to provide cooling and additional insulation for the electrical insulating bushing 10. As a load is applied to the bushing 10, the electrical conductor 28 will generate quantities of heat which will raise the temperature of the fluid 23 contained in the first channel 36 and the second channel 32. The fluid 23 will rise in the first channel 36 and the second channel 32 by thermosiphon action which will draw cooler oil from the third channel 24 into the lower end of the first channel 36 and also through apertures 38 into the lower end of the second channel 32. Thus, the dielectric coolant 23 flowing through the first channel 36 will flow into the upper end of the third channel 24 wherein it will be cooled by transferring the heat contained therein to the outer air through the exterior bushing housing 14. Similarly, the coolant 23 rising in the second channel 32 will flow through the apertures 42 into the third channel 24 and be cooled as it is returned to the bottom of the housing 14.

To ensure even cooling over the entire length of the inner and outer surfaces of the electrical conductor 28, the fluid flow resistance of the first channel 36 and the second channel 34 must be approximately equal. If the flow resistances of the first channel 36 and the second channel 32 are not equal, the channel having the smaller flow resistance would, accordingly, carry most of the oil flow. This would cause an excessive temperature rise on the surface of the electrical conductor exposed to the channel having the larger flow resistance which would adversely affect the overall current carrying capability of the electrical bushing 10.

The flow resistance of a channel depends upon the cross-sectional area and the length of the channel and also the number of individual channels or paths that make up a channel. Since, in the preferred embodiment of this invention, the length of the first channel 36 is approximately equal to the length of the second channel 32 and the cross-sectional area of the spacer members that form the first channel 36 between the conductor 28 and the layer of insulative material 22 is small in comparison to the cross-sectional area of the first channel 36, the factor that largely determines the flow resistance is the cross-sectional area of the first and second channels 36 and 32, respectively. Thus, the outer diameter of the tubular member 30, which could be constructed of stainless steel, aluminum or other suitable non-magnetic material, would be selected such that the cross-sectional area of the second channel 32 between the tubular member 30 and the inner surface of the electrical conductor 28 would be approximately equal to the cross-sectional area of the first channel 36 between the outer surface of the electrical conductor 28 and the inner surface of the ducts formed in the insulative material 22. In addition to equalizing flow rates and heat dissipation, the presence of the tubular member 30 within the electrical conductor 28 provides a sufficiently narrow cross-section such that the flow of dielectric coolant therethrough is prevented from eddying which aids in increasing coolant flow across the surfaces of the electrical conductor 28 by increasing the thermal head caused by the thermosiphon flow of the dielectric fluid through the channels.

The bushing described above has increased current carrying capability over bushings constructed according to prior art methods. By providing equal parallel flow of coolant across the inner and outer surfaces of an electrical conductor, a bushing constructed according to the teachings of this invention has a higher current rating than prior art bushings since greater quantities of heat are dissipated from the electrical conductor by the dielectric coolant, thereby enabling a similar sized bushing to operate at higher current ratings than a bushing constructed according to prior art methods, especially in those bushings wherein the coolant flows serially across the inner and outer surfaces of the electrical conductor. Furthermore, the paralleling of coolant flow across the inner and outer surfaces of the electrical conductor provides the added advantage of increasing the efficiency of thermosiphon flow of the coolant fluid thereby eliminating the need for a mechanical pump to force the oil across the electrical conductor in sufficient quantities to adequately cool it.

Figure 4:
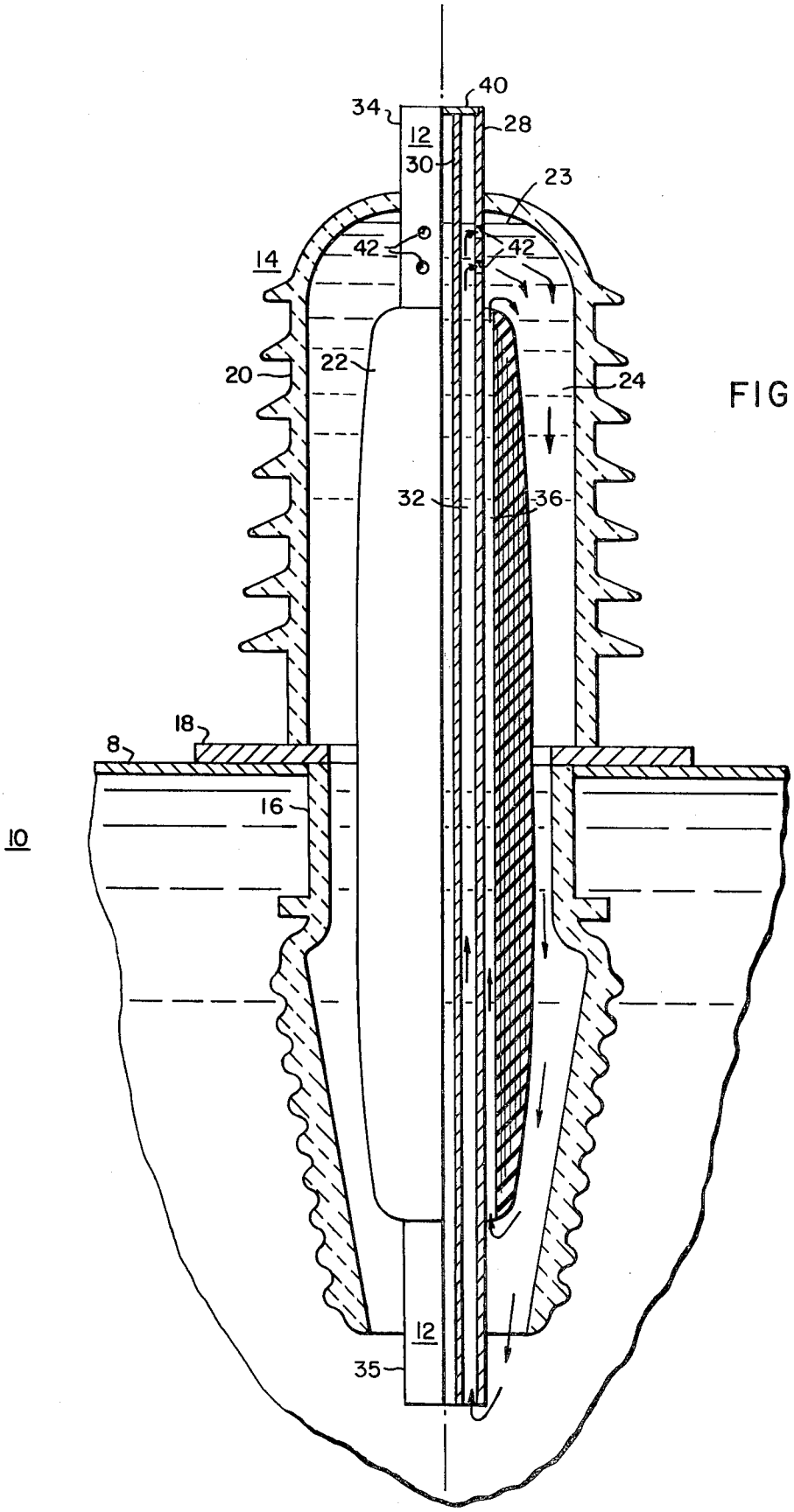
FIG. 4 is an elevational view, partially in section and partially broken away, of an electrical insulating bushing.

In certain applications, it is common to have the portion of the bushing that extends into the tank open such that the dielectric fluid within the tank is free to circulate in the bushing 10. FIG. 4 depicts an alternate embodiment of a bushing constructed according to the teachings of this invention for use in such an application. The bushing 10 shown in FIG. 4 is constructed and operates identically as that shown in FIG. 1 and described above with the exception that the lower end of the housing 14 and the conductor 28 are not sealed and further that the apertures 38 in the conductor 28 are not required.

The lower end of the housing 14 is thus spaced from the conductor 28 to define a fluid flow path for coolant between the third channel 24 in the bushing 10 and the interior of the tank 8. The coolant flowing through the third channel 24 from the top of the bushing 10 thus flows into the first channel 36 as described above and the tank 8.

The second channel 32 is disposed in fluid flow communication with the interior of the tank 8 such that dielectric coolant will flow from the tank 8 into the second channel 32 by thermosiphon action.

Thus, the dielectric coolant will flow by thermosiphon action from the tank 8 through the second channel 32 and from the third channel 24 through the first channel 36 and thereby transfer heat from the conductor 28 in the same manner as previously described.

Figure 2:
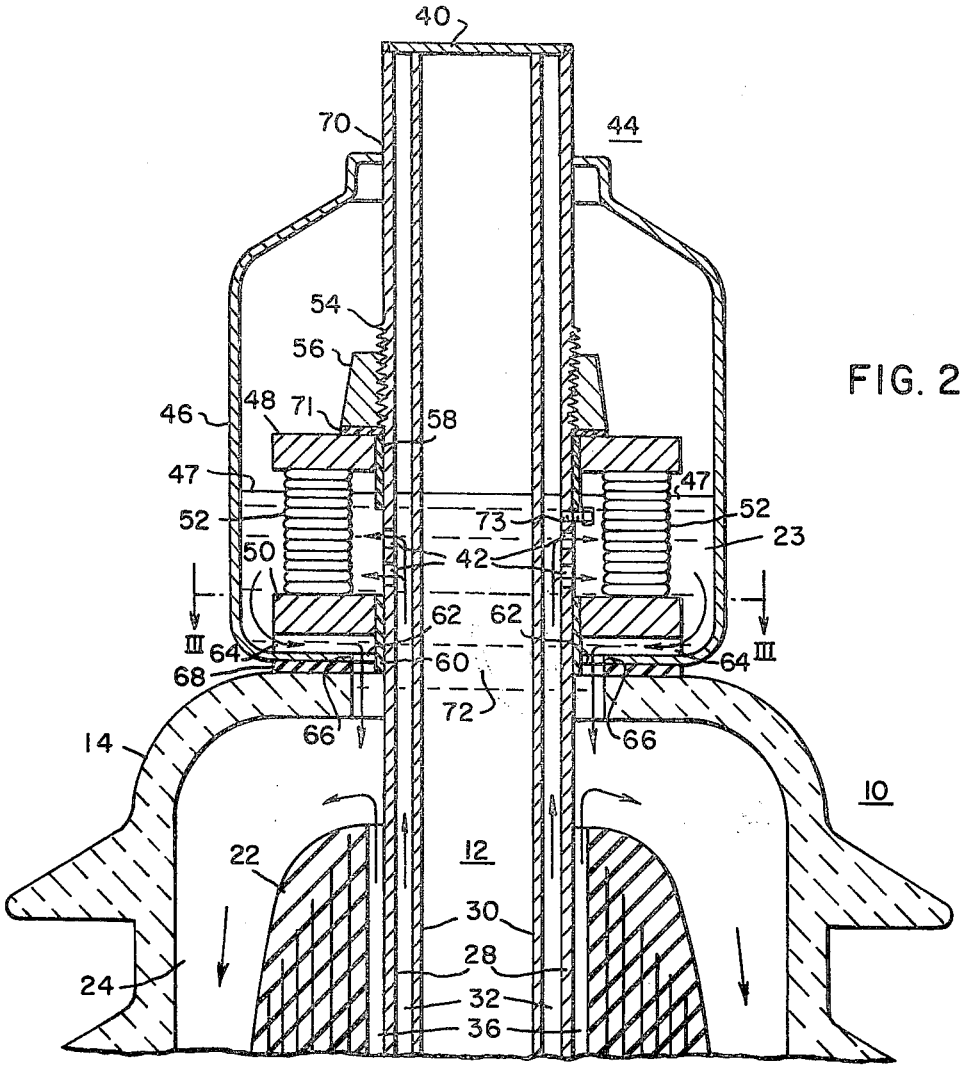
FIG. 2 is an enlarged sectional view of the upper portion of an electrical insulating bushing showing another embodiment of this invention.

There is shown in FIG. 2, another embodiment of an electrical insulating bushing constructed according to the teachings of this invention. FIG. 2 is a detailed sectional view of the upper portion of an electrical insulating bushing 10 wherein an expansion cap 44 is utilized to maintain an oil-tight seal for the bushing 10. As is well known in the art, the thermal coefficients of expansion of the porcelain housing 14 and the metallic electrical conductor 28 are different which presents sealing problems for the bushing 10 as it heats up under load. A common solution is to provide an expansion cap, such an expansion cap 44, wherein a plurality of compression springs are mounted which exert tensile stress on the electrical conductor and compressive stress on the bushing housing, to maintain an adequate oil-tight seal for the bushing 10.

Accordingly, expansion cap 44 consists of a hollow casing 46, constructed of a suitable metallic material such as copper or aluminum, which surrounds the upper portion of the electrical conductor 12. The casing 46 includes first and second openings, 70 and 72 respectively, through which the central conductor 12 extends. The first end 70 is joined to the electrical conductor 28 by suitable means, such as brazing or soldering. The lower or second end 72 of the hollow casing 46 is disposed in registry with an insulative member 68 described below and the insulative housing 14. Contained within the hollow casing 46 is a first or upper annular spring seat 48 and a second or lower annular spring seat 50 both of which are spaced from the outer electrical conductor 28 by suitable insulating means also described below. A plurality of compression spring assemblies are circumferentially spaced around the electrical conductor 28 and disposed between and bearing on the first spring seat 48 and the second spring seat 50.

Additionally, a portion of the electrical conductor 28 which is disposed within the hollow casing 46 of the expansion cap 44 contains a plurality of external threads 54. A spring support collar or spanner nut 56 is threadedly engaged onto the threads 54 and bears upon the surface of the first spring seat 48 opposite that surface on which the compression springs 52 bear. Thus, the compression spring assemblies 52 will exert tensile stress upon the upper spring seat 48 and the spanner nut 56 and thereby maintain a constant tensile force on the electrical conductor 28. Additionally, the compression spring assemblies 52 will exert compressive stress on the lower spring seat 50 which is in contact with the lower end 72 of the hollow casing 46 of the expansion cap 44. The compressive stress exerted on the bottom portion of the casing 46 by the compression springs 52 will maintain a constant compressive force on a sealing means or gasket 68 which is disposed between the bottom portion of the hollow casing 46 and the outer bushing housing 14 and a constant compressive force between the expansion cap 44 and the upper porcelain section 20 of the bushing 10 and also between the upper porcelain section 20 and the lower procelain section 16 of the bushing 10 despite expansion of the outer bushing housing 14 during operating conditions.

The expansion cap 44 described above has been utilized to provide an adequate oil-tight seal for the bushing 10 despite dimensional variations due to thermal expansion of the metallic conductor 28 and the procelain housing 14 of the bushing 10. In addition, the cap 44 provides spaces for the coolant 23 to expand when under load. However, in prior art bushings, the portion of the electrical conductor 28 contained within the casing 46 of the expansion cap 44 is not directly exposed to the flow of dielectric coolant 23 and, as such, only a small amount of the heat generated by this portion of the electrical conductor 28 is dissipated through the metallic casing 46 of the expansion cap 44. Thus, the portion of the electrical conductor 28 within the expansion cap 44 experiences an excessive temperature rise due to inadequate cooling.

FIG. 2 depicts an improved electrical insulating bushing 10 construction whereby the dielectric coolant contained within the bushing 10 is allowed to flow into the expansion cap 44 and thereby cool the portion of the electrical conductor 28 contained within the expansion cap 44. This construction offers the added advantage of providing additional capacity for dissipating the heat picked up by the coolant as it flowed over the inner surface of the electrical conductor 28 since the metallic casing 46 of the expansion cap 44 provides substantial surface area to transfer heat from the coolant to the ambient air. Accordingly, the electrical conductor 28 contains a plurality of circumferentially spaced second apertures or openings 42 which dispose the upper end of the second channel 32 in fluid flow communication with the interior of the hollow casing 46 of the expansion cap 44. The openings 42 are located below the normal level 47 of coolant 23 contained in the cap 44. Thus, the dielectric coolant flows through the second channel 32 into the expansion cap 44 through the apertures 42 instead of flowing into the third channel 24 in the exterior bushing housing 14 as in the other embodiment of this invention. It is also contemplated that the first channel 36 may be extended into the expansion cap 44 to provide additional oil flow into the cap 44.

Figure 3:
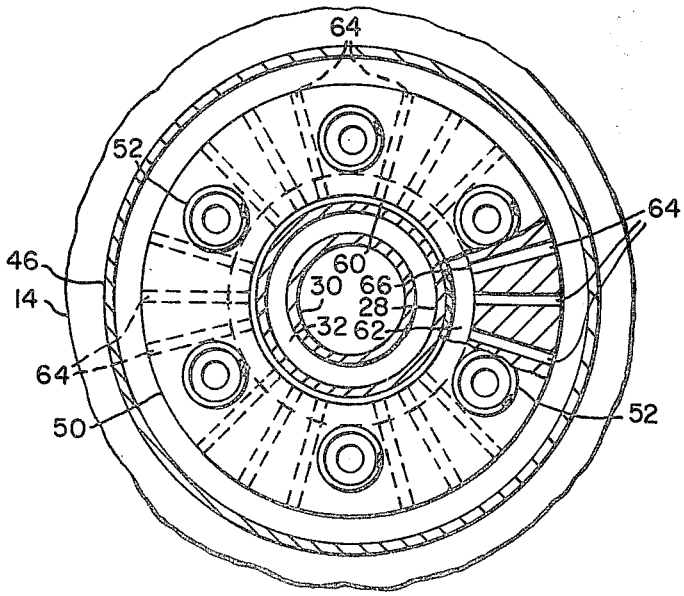
FIG. 3 is a sectional view of the lower spring seat, generally taken along line III—III in FIG. 2.

In order to force the dielectric coolant along the walls of the hollow casing 46, a plurality of radially extending ducts 64 are provided in the lower spring seat 50, as shown in FIG. 3. One end of each of the ducts 64 opens into the interior of the hollow casing 46 of the expansion cap 44; while the other end of each duct 64 extends into an opening 62 in an annular shoulder portion 66 of the bottom surface of the lower spring seat 50. The bottom end of the casing 46 abuts the shoulder portion 66 such that each opening 62 is disposed in fluid flow communication with the housing 14 thereby providing a fluid flow path for the dielectric coolant contained within the interior of the hollow casing 46 through the ducts 64 and the openings 62 into the third channel 24 in the exterior bushing housing 14.

Thus, in actual operation, the dielectric coolant 23 will rise in the first duct 36 and the second duct 32 by thermosiphon flow. The coolant 23 will flow from the upper end of the first channel 36 into the third channel 24 and thereby cool the outer surface of the electrical conductor 28. At the same time the dielectric coolant 23 in the second channel 32 will flow through the apertures 42 into the expansion cap 44 and thereby remove heat from the inner surface of the electrical conductor 28 and the portion of the electrical conductor contained within the expansion cap 44. A portion of this heat will be dissipated through the hollow casing 46 of the expansion cap 44. The dielectric coolant 23 contained in the expansion cap 44 will continue to flow through the ducts 64 in the lower spring seat 50, through the openings 62 in the lower spring seat 50 and into the third channel 24 within the outer bushing housing 14. The heat picked up by the fluid as it flows through the first channel 36 and the second channel 32 will be dissipated through the outer porcelain housing 14 as the dielectric fluid 23 flows through the third channel 24 to the bottom of the bushing 10.

As described previously, insulating material is disposed between the conductor 23 and both the upper spring seat 48 and the lower spring seat 50 in order to isolate the compression springs from the current carrying electrical conductor 28 and thereby prevent the generation of circulating currents and magnetic losses in the springs 52. A common method of isolating the springs from the electrical lead in prior art bushings consisted of placing a continuous tube of insulating material around the conductor between the lower spring plate and the upper spring plate. However, this has the undesirable feature of thermally insulating the electrical conductor which created an excessive temperature rise in this portion of the conductor. In order to eliminate this excessive temperature rise in this portion of the conductor 28, separate insulating members are utilized between the upper spring seat 48 and the lower spring seat 50. As shown in FIG. 2, a first annular insulating member 58, of suitable insulating material such as pressboard or "Micarta", is disposed between the first spring seat 48 and the electrical conductor 28 which effectively isolates the first spring seat 48 from the electrical conductor 28. An additional insulating member or gasket 71 is disposed between the spanner nut 56 and the upper surface of the first spring seat 48 to further isolate the first spring seat 48 from the electrical conductor 28. A second annular insulating member 60 is similarly disposed between the second spring seat 50 and the electrical conductor 28 to provide isolation therefor. The insulating members are held in position by suitable means, such as bonding the insulating member to the electrical conductor as is done for the second insulating member 60 or containing the insulating member in position as is shown for the first insulative member 58 which is held in position by the spanner nut 56 and a plug 73. In this manner, the dielectric coolant 23 is free to circulate next to the portion of electrical conductor 28 contained within the expansion cap 44 and remove heat therefrom.

A bushing, constructed according to the teachings of this invention, was surprisingly found to have a current rating 40% higher than that obtainable from similar sized bushings constructed according to prior art methods. By paralleling the flow of dielectric coolant across the inner and outer surfaces of the electrical conductor, sufficient quantities of heat can be dissipated from the conductor which enables a smaller sized bushing to carry a higher current than would normally be expected. In addition, efficient flow of the dielectric coolant by thermosiphon action eliminates the need for a mechanical pump to force sufficient quantities of the coolant through the channels in order to adequately cool the electrical conductor. Furthermore, by discharging the flow of one of the channels into the expansion cap, not only is the portion of the electrical conductor contained within the expansion cap adequately cooled, but also additional cooling capacity is achieved since the dielectric coolant can dissipate additional quantities of heat to the ambient air through the substantial metallic surface area of the casing of the expansion cap. Finally, by isolating each spring seat in the expansion cap from the electrical conductor by individual insulative members, the portion of electrical conductor contained within the expansion cap can be exposed to the flow of dielectric coolant which prevents an excessive temperature rise in that portion of the conductor.

Thus, it will be apparent to one skilled in the art that there has been disclosed a new and improved electrical insulating bushing which has a higher current-carrying capability than bushings known in the prior art. By novelly creating equal, parallel flow of dielectric coolant across the entire inner and outer surfaces of the electrical conductor of an insulating bushing through parallel channels disposed around the entire inner and outer surfaces of the conductor, sufficient quantities of heat can be dissipated from the conductor without the need for forced coolant flow by means of a pump, which enables a smaller sized insulating bushing to carry a significantly higher current. Furthermore, by discharging the coolant into the expansion cap of an electrical insulation bushing and by insulating only the portion of the electrical conductor contained therein that is surrounded by the upper and lower spring seats, the portion of the conductor contained within the expansion cap is adequately cooled and furthermore an additional cooling capacity is achieved by exposing a portion of the coolant to the substantial metallic surface area of the casing of the expansion cap.

What is claimed is:

1. An electrical insulating bushing comprising:

a hollow electrical conductor having inner and outer surfaces and first and second ends;

a first longitudinally extending member surrounding and radially spaced from said conductor and defining a first longitudinally extending annular channel between said outer surface of said conductor and said first member, said first longitudinally extending member being formed of electrical insulating material;

a second longitudinally extending member concentrically disposed within and radially spaced from said conductor and defining a second longitudinally extending annular channel between said inner surface of said conductor and said second member;

an electrical insulating housing surrounding and spaced from said first member and defining a longitudinally extending third channel therebetween; and dielectric fluid filling said housing to a predetermined level;

said first and second channels being disposed in fluid flow communication with said third channel at opposite ends of said electrical conductor such that said dielectric fluid will flow in parallel through said first and second channels and thereby remove heat from said inner and outer surfaces of said conductor, respectively, which heat is dissipated to the ambient air through said housing as said dielectric fluid flows through said third channel, said first and second channels having substantially equal fluid flow resistances such that said dielectric fluid flows through both of said first and second channels at substantially the same flow rate.

2. An electrical insulating bushing comprising:

a hollow electrical conductor having inner and outer surfaces and first and second ends;

a first longitudinally extending member surrounding and radially spaced from said conductor and defining a first longitudinally extending annular channel between said outer surface of said conductor and said first member;

a second longitudinally extending member concentrically disposed within and radially spaced from said conductor and defining a second longitudinally extending annular channel between said inner surface of said conductor and said second member;

an electrical insulating housing surrounding and spaced from said first member and defining a longitudinally extending third channel therebetween;

dielectric fluid filling said housing to a predetermined level;

means for introducing said fluid into said first and second channels in parallel such that said fluid will flow in parallel through said first and second channels and thereby dissipate heat from said inner and outer surfaces of said conductor, respectively;

said first and second channels being disposed in fluid flow communication with said third channel such that the heat contained in said fluid is transferred to the ambient air through said housing as said fluid flows through said third channel;

said conductor containing an aperture adjacent its first end and a casing surrounding the portions of said conductor containing said aperture;

said casing having first and second ends through which said conductor extends, said first end of said casing sealably connected to said conductor, said second end of said casing sealably connected to said electrical insulative housing;

spring means disposed within said casing, for exerting tensile stress on said conductor and compressive stress on said second end of said casing to hold said casing in sealed relationship with said insulative housing; and means for disposing said casing in fluid flow communication with said housing such that a fluid flow path is formed between the second and third channels through said aperture and said casing in which said dielectric fluid is diverted across the surface of said casing as it flows therethrough.

3. The bushing of claim 2 wherein a portion of the conductor disposed within the casing contains a plurality of external threads and further wherein the spring means includes first and second spaced, annular spring seats, said first spring seat disposed adjacent said threaded portion of said conductor, said second spring seat disposed adjacent the second end of the casing, a plurality of compression springs circumferentially disposed between said first and second spring seats and bearing thereon, a spring support collar threadably engaged with said threads on said conductor and disposed on the opposite side of said first spring seat from said springs to resist outward force exerted thereon, and means for electrically insulating said first and second spring seats from said conductor.

4. The bushing of claim 3 wherein the spring seat insulating means includes a first annular insulative member disposed between said first seat and said conductor and a second annular insulative member disposed between said second seat and said conductor.

5. The bushing of claim 4 wherein the means for disposing the casing in fluid communication with the housing includes the second spring seat having a plurality of radially extending ducts extending completely through said 6. An electrical insulating bushing comprising:

a hollow electrical conductor having first and second sealed ends;

a layer of electrical insulating material surrounding and radially spaced from a portion of said conductor and defining a longitudinally extending first annular channel between said conductor and said layer of insulative material;

a longitudinally extending tubular member concentrically disposed within and radially spaced from said conductor and defining a longitudinally extending second annular channel between said conductor and said tubular member, said tubular member extending the entire length of said conductor;

an electrical insulative housing having first and second ends, said housing surrounding and spaced from said layer of insulative material and defining a longitudinally extending third channel between said insulative housing and said layer of insulative material, said third channel disposed in fluid flow communication with said first channel, said first end of said insulative housing sealably connected to said conductor;

said conductor having a plurality of first apertures adjacent said second end defining a fluid flow path between said second channel and said third channel;

said first channel having a fluid flow resistance that is substantially equal to the fluid flow resistance of said second channel;

a hollow casing having first and second ends with said conductor extending therethrough, said first end of said casing being sealably connected to said conductor, said second end of said casing being sealably connected to said second end of said insulative housing and spaced from said conductor;

said conductor having a plurality of external threads at a predetermined position on the portion of said conductor disposed within said casing;

a compression spring assembly disposed within said casing;

said spring assembly including first and second spaced annular spring seats, said first spring seat disposed adjacent said threaded portion of said conductor, said second spring seat disposed adjacent said second end of said casing and bearing thereon, a plurality of compression springs being circumferentially disposed between said first and second spring seats and bearing thereon, a spring support collar threadably engaged with said threads on said conductor and disposed on the opposite side of said first spring seat from said compression springs to resist outward force exerted thereon;

a first annular insulative member disposed between said first spring seat and said conductor;

a second annular insulative member disposed between said second spring seat and said conductor;

said conductor including a plurality of circumferentially spaced second apertures in the portion of said conductor disposed within said casing, said second apertures disposing said second channel in fluid flow communication with said casing;

said second spring seat including a plurality of radially extending ducts, one end of said ducts disposed in fluid flow communication with said casing, the other end of said ducts disposed in fluid flow communication with said third channel in said insulative housing such that a fluid flow path is defined between said second apertures in the portion of said conductor contained within said casing, said casing, said ducts, and said third channel in said electrical insulative housing; and dielectric fluid filling said housing and said casing to a predetermined level above said second apertures in said conductor.

7. Electrical inductive apparatus comprising:

a sealed enclosure;

an electrical member disposed in said enclosure;

dielectric fluid disposed in said enclosure;

an electrical insulating bushing extending through said enclosure, said electrical insulating bushing comprising:

a hollow electrical conductor having inner and outer surfaces and first and second ends;

a first longitudinally extending member surrounding and radially spaced from said conductor and defining a first longitudinally extending annular channel between said outer surface of said conductor and said first member, said first longitudinally extending member being formed of electrical insulating material;

a second longitudinally extending member concentrically disposed within and radially spaced from said conductor and defining a second longitudinally extending annular channel between said inner surface of said conductor and said second member;

an electrical insulating housing surrounding and spaced from said first member and defining a longitudinally extending third channel therebetween; and dielectric fluid filling said housing to a predetermined level;

said first and second channels being disposed in fluid flow communication with said third channel at opposite ends of said electrical conductor such that said dielectric fluid will flow in parallel through said first and second channels and thereby remove heat from said inner and outer surfaces of said conductor, respectively, which heat is dissipated to the ambient air through said housing as said dielectric fluid flows through said third channel, said first and second channels having substantially equal fluid flow resistances such that said dielectric fluid flows through both of said first and second channels at substantially the same flow rate, said first, second and third channels further being disposed in fluid flow communication with said enclosure.

* * * * *